US007361863B2

(12) United States Patent
Tsunoda

(10) Patent No.: US 7,361,863 B2
(45) Date of Patent: Apr. 22, 2008

(54) FIXING DEVICE AND IMAGE FORMING APPARATUS

(75) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 104 days.

(21) Appl. No.: 11/476,705

(22) Filed: Jun. 29, 2006

(65) Prior Publication Data

US 2007/0000899 A1 Jan. 4, 2007

(30) Foreign Application Priority Data

Jun. 30, 2005 (JP) ..... 2005-190855

(51) Int. Cl.
*G03G 15/20* (2006.01)
*H05B 3/00* (2006.01)

(52) U.S. Cl. ..... 219/216; 399/69; 399/329; 399/331

(58) Field of Classification Search ..... None
See application file for complete search history.

(56) References Cited

U.S. PATENT DOCUMENTS 6,181,891 B1 * 1/2001 Higashi et al. ..... 399/69
6,898,410 B2 * 5/2005 Boss ..... 399/330
7,193,180 B2 * 3/2007 Cook et al. ..... 219/216
2004/0247334 A1 * 12/2004 Kishi et al. ..... 399/69

FOREIGN PATENT DOCUMENTS

JP 2002-196604 12/2002
JP 2004-191488 A * 7/2004

* cited by examiner

*Primary Examiner*—J. Pelham
(74) *Attorney, Agent, or Firm*—Kubotera & Associates, LLC

(57) ABSTRACT

A fixing device includes a fixing member; a pressing member to be pressed against the fixing member; a first heating member for heating the fixing member; a second heating member for heating the fixing member supplementarily; and a third heating member for heating the pressing member. The first heating member has a first rated output; the second heating member has a second rated output; and the third heating member has a third rated output. The first rated output is greater than the second rated output, and the second rated output is equal to or greater than the third rated output. Further, the second heating member and the third heating member are connected in series relative to a voltage applying device or a power source.

11 Claims, 9 Drawing Sheets

FIXING DEVICE AND IMAGE FORMING APPARATUS

BACKGROUND OF THE INVENTION AND RELATED ART STATEMENT

The present invention relates to a fixing device and an image forming apparatus.

In a conventional image forming device of an electric photography type such as a printer, a copier, and a facsimile, a fixing device of a thermal roller type is provided for fixing a toner image transferred to a sheet. Such a fixing device is provided with a fixing roller as a fixing member and a pressing roller. When the sheet passes through a nip portion formed between the fixing roller and the pressing roller, a toner image is fixed to the sheet.

In a fixing device of an endless belt type, an endless belt (fixing belt) is provided between a heating roller and a fixing roller as a fixing member, so that the fixing roller is pressed against a pressing roller with the fixing belt in between.

In the fixing device of the belt type, as compared with the fixing device of the thermal roller type, it is possible to reduce power consumption. Further, it is possible to reduce a period of time necessary for achieving a state capable of fixing from an idle state, that is, to reduce a period of time necessary for increasing a temperature. This is because a belt has a relatively small heat capacity, and it is easy to control a temperature. However, due to the small heat capacity, a temperature tends to drop rather quickly during fixing. To this end, a heater may be provided in each of the heating roller and the pressing roller (for example, refer to Patent Reference).

Patent Reference: Japanese Patent Publication No. 2002-196604

In the conventional fixing device, the nip portion is formed between the fixing roller and the pressing roller. The fixing roller is formed of a material with a large heat capacity such as a silicone rubber. Still, when sheets pass through consecutively, the fixing roller tends to lose heat very rapidly. To compensate the heat loss, the fixing roller is heated through thermal control. However, it is difficult to quickly heat a surface of the fixing roller due to the large heat capacity and low responsiveness. On the other hand, when the fixing roller is heated continuously for a long period of time, the fixing roller may be heated too high, thereby causing a fixing problem due to a high temperature.

In view of the problems described above, an object of the present invention is to provide a fixing device and an image forming apparatus capable of solving the problems. In the fixing device, it is possible to prevent a temperature of a fixing member from increasing rapidly, thereby preventing a fixing problem.

Further objects and advantages of the invention will be apparent from the following description of the invention.

SUMMARY OF THE INVENTION

In order to attain the objects described above, according to the present invention, a fixing device comprises a fixing member; a pressing member to be pressed against the fixing member; a first heating member for heating the fixing member; a second heating member for heating the fixing member supplementarily; and a third heating member for heating the pressing member. The first heating member has a first rated output; the second heating member has a second rated output; and the third heating member has a third rated output. The first rated output is greater than the second rated output, and the second rated output is equal to or greater than the third rated output. Further, the second heating member and the third heating member are connected in series relative to a voltage applying device or a power source.

In the invention, the fixing device comprises the fixing member; the pressing member to be pressed against the fixing member; the first heating member for heating the fixing member; the second heating member for heating the fixing member supplementarily; and the third heating member for heating the pressing member. The first heating member has the first rated output; the second heating member has the second rated output; and the third heating member has the third rated output. The first rated output is greater than the second rated output, and the second rated output is equal to or greater than the third rated output. Further, the second heating member and the third heating member are connected in series relative to the voltage applying device or the power source.

In particular, the first heating member is disposed in the fixing member. Accordingly, it is possible to prevent a temperature of the fixing member from decreasing rapidly, thereby preventing a fixing problem. Further, the second heating member and the third heating member are connected in series relative to the voltage applying device. Accordingly, it is possible to reduce the second rated output and the third rated output without reducing a wire diameter of the second heating member and the third heating member.

DETAILED DESCRIPTION OF PREFERRED EMBODIMENTS

Hereunder, embodiments of the present invention will be explained with reference to the accompanying drawings. In the embodiments, a color printer is used as an image forming apparatus for forming an image in a printing operation.

First Embodiment

Figure 2:
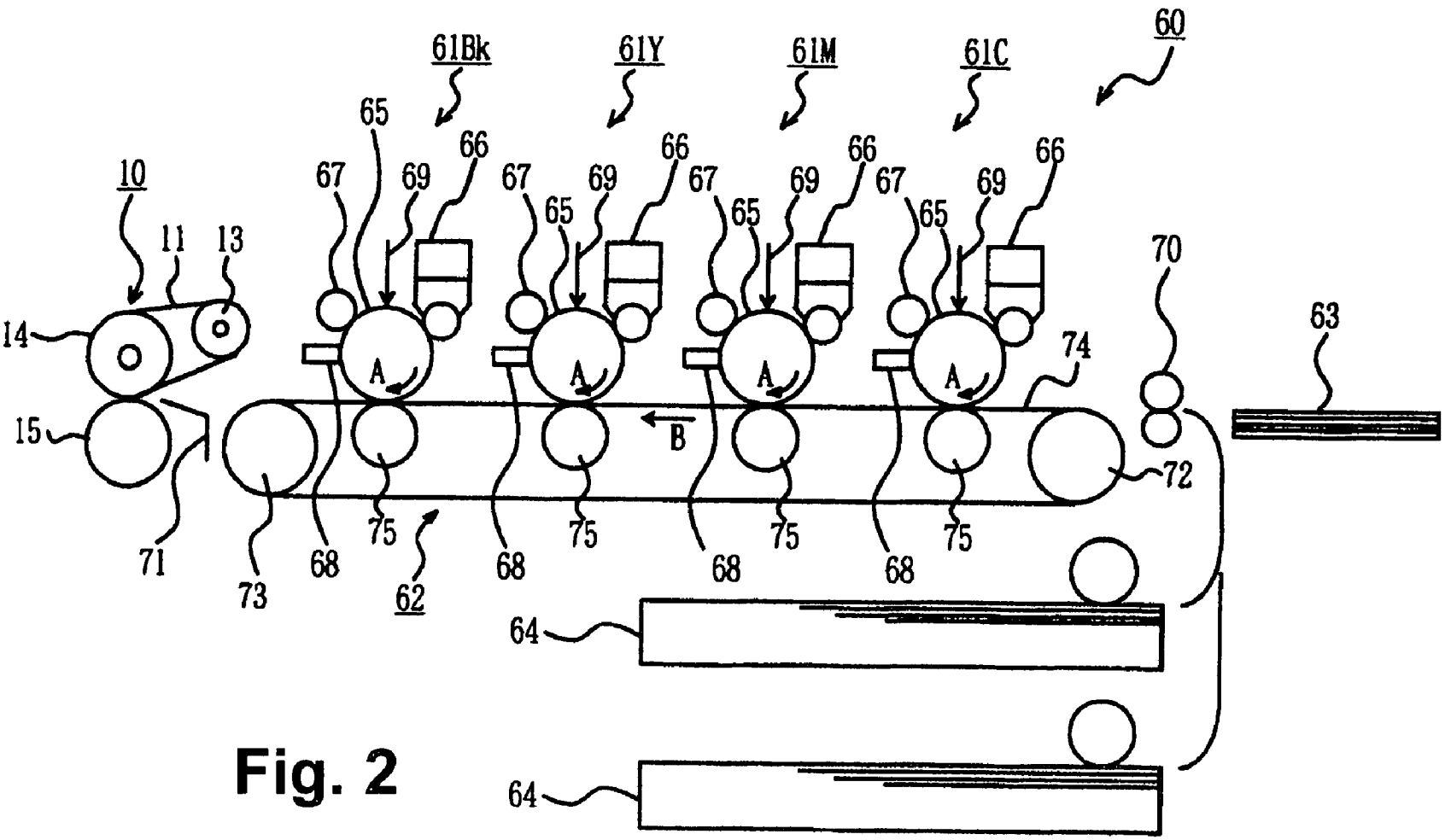
FIG. 2 is a schematic view showing a printer according to the first embodiment of the present invention.

FIG. 2 is a schematic view showing a printer 60 according to a first embodiment of the present invention. As shown in FIG. 2, the printer 60 includes operation units 61C, 61M, 61Y, and 61Bk for forming toner images as developer images in colors such as cyan, magenta, yellow, and black, respectively, according to image data; a transfer device 62 of a belt type arranged to face the operation units 61C, 61M, 61Y, and 61Bk to form transfer areas in the colors in areas between the transfer device and the operation units 61C, 61M, 61Y, and 61Bk for transferring the toner images in the colors to a sheet as a recording medium; a manual sheet supply tray 63 as a first medium supply unit for supplying sheets to the transfer areas; sheet supply cassettes 64 disposed according to types of sheets as second medium supply units for supplying sheets to the transfer areas; a resist roller 70 for supplying the sheet from the manual sheet supply tray 63 or the sheet supply cassettes 64 to the transfer areas according to an image forming timing at the operation units 61C, 61M, 61Y, and 61Bk; and a fixing device 10 for fixing the toner images transferred at the transfer areas.

The fixing device 10 includes a heating roller 13 as a heating member or a first rotational member; a fixing roller 14 as a fixing member or a second rotational member; a fixing belt 11 disposed between the heating roller 13 and the fixing roller 14 as a belt member; a pressing roller 15 as a pressing member or a third rotational member to be pressed against the fixing roller 14 with the fixing belt 11 in between; and a guide 71 for guiding the sheet to a nip portion as a fixing area between the fixing belt 11 and the pressing roller 15. A fixing member is formed of the heating roller 13, the fixing roller 14, and the fixing belt 11.

The sheet includes an ordinary sheet used for a copier as well as an OHP sheet, a card, a postcard, a cardboard having a weight of 100 g/m$^2$ or larger, and an envelope. Further, it is possible to use a special sheet having a large heat capacity.

The operation units 61C, 61M, 61Y, and 61Bk have an identical structure including a photosensitive drum 65 as an image supporting member disposed to be freely rotatable in an arrow direction A; and a charging roller 67, a developing unit 66 and a cleaning unit 68 disposed in this order along a rotational direction of the photosensitive drum 65. An exposing device (not shown) irradiates exposure light 69 on an area between the charging roller 67 and the developing unit 66.

The transfer device 62 includes a first roller and a second roller 72 and 73; a transfer belt 74 disposed between the first roller and the second roller 72 and 73 as an endless transfer medium moving in an arrow direction B; and transfer rollers 75 as transfer members disposed to face the photosensitive drums 65 and be rotatable freely. The photosensitive drum 65 as the image supporting member may be replaced with a photosensitive belt member.

An operation of the printer 60 will be explained next. When an operator turns on the printer 60 and starts a printing operation, the photosensitive drums 65 rotate in the arrow direction A and are charged with the charging rollers 67 while rotating. When the photosensitive drum 65 receives the exposure light 69, a latent image is formed on a surface of the photosensitive drum 65 according to image data. Then, the developing unit 66 attaches toner as developer to the photosensitive drum 65, thereby developing the latent image to form the toner image.

While the transfer belt 74 moves in the arrow direction B, the toner images in cyan, magenta, yellow, and black are sequentially transferred to the sheet to form the toner image in colors. The sheet is transported to the guide 71, and is supplied to the nip portion with the guide 71, so that the toner image in colors on the sheet is heated and fixed to the sheet. The cleaning units 68 remove toner remaining on the photosensitive drums 65 after the transfer operation. In the embodiment, the toner image on the photosensitive drum 65 is directly transferred to the sheet. Alternatively, the toner image may be transferred to the transfer belt 74, and then transferred to the sheet.

Figure 1:
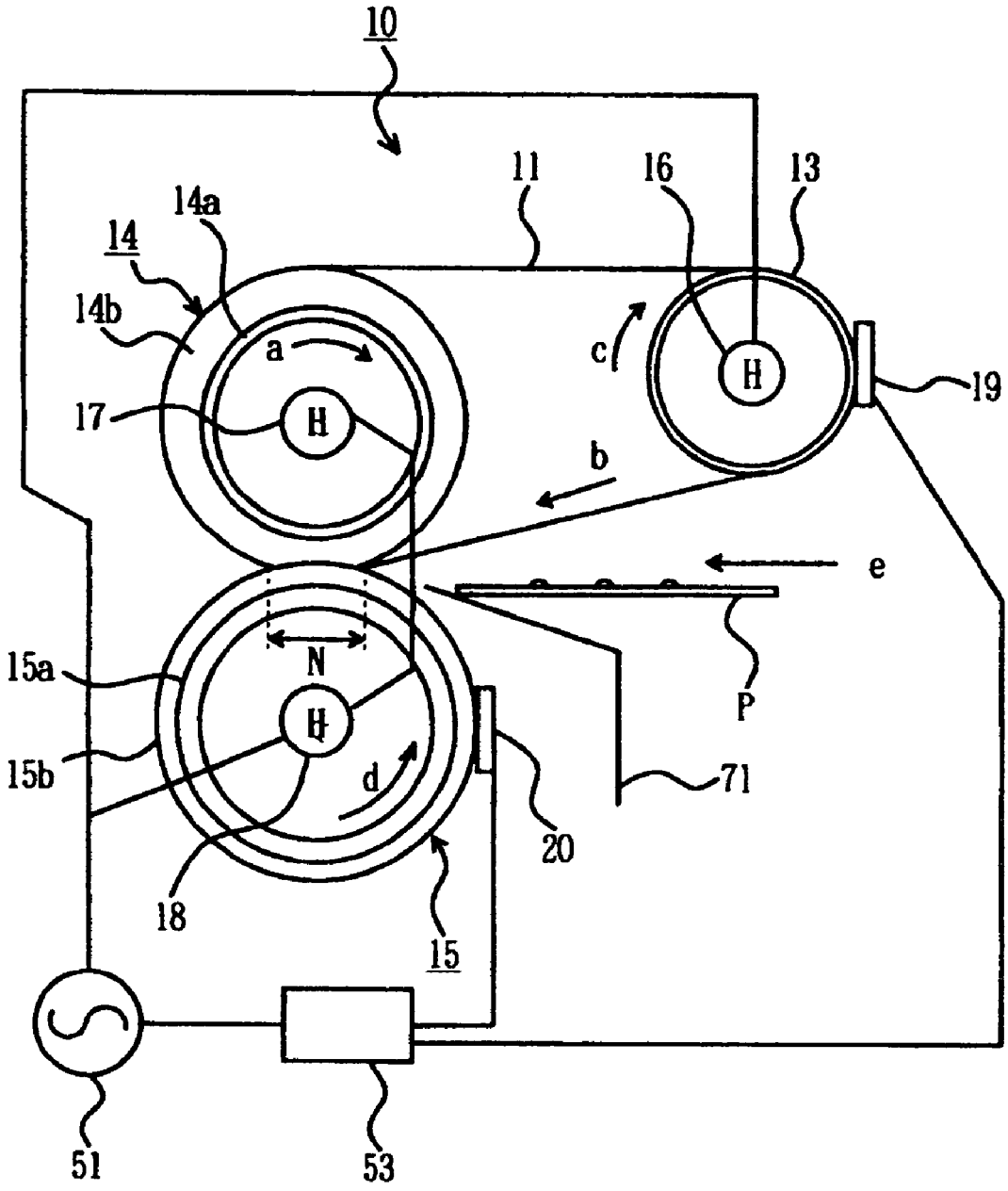
FIG. 1 is a schematic side view showing a fixing device according to a first embodiment of the present invention.
Figure 3:
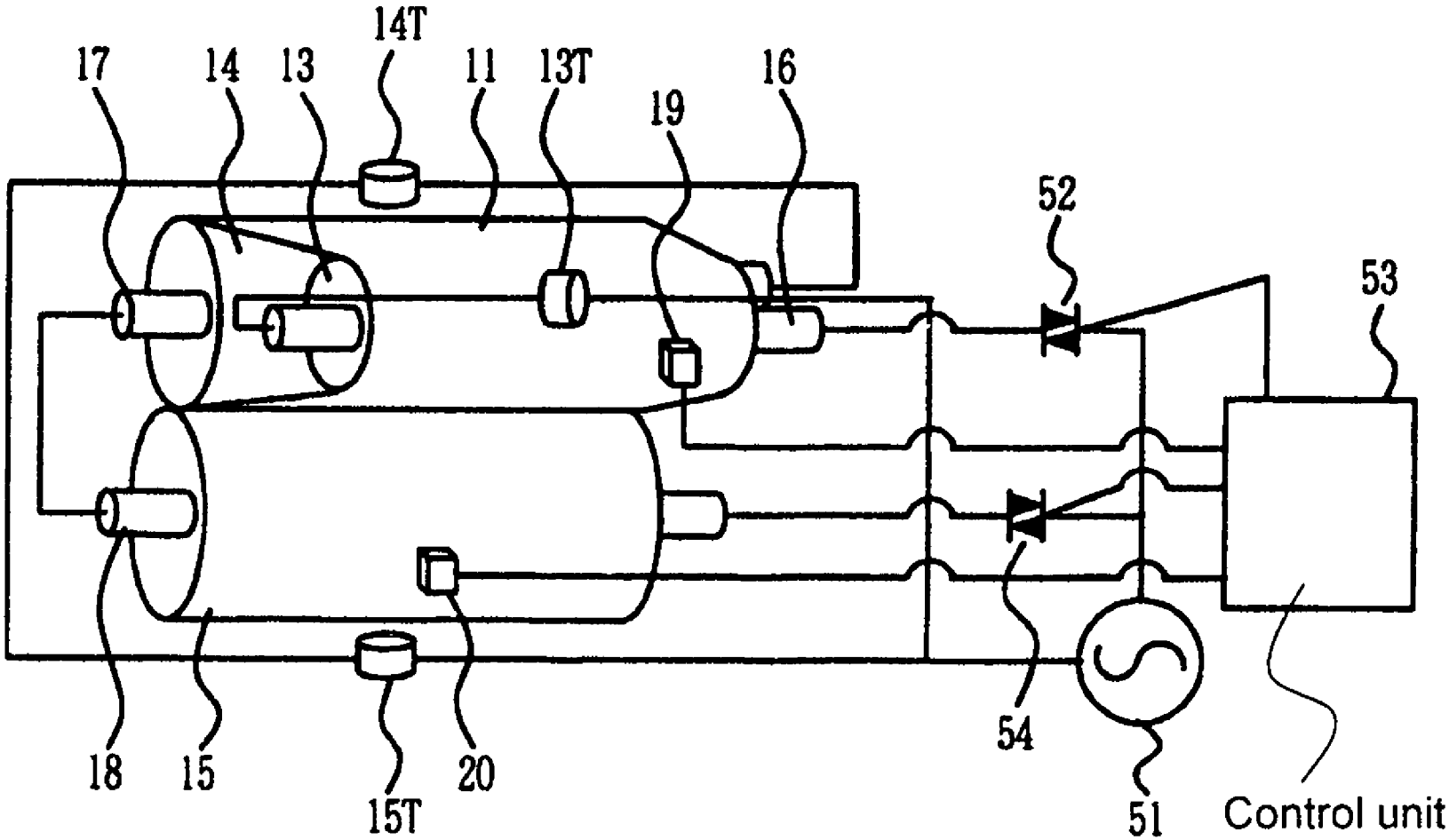
FIG. 3 is a schematic view showing the fixing device according to the first embodiment of the present invention.

A configuration of the fixing device 10 will be explained next. FIG. 1 is a schematic side view showing the fixing device 10 according to the first embodiment of the present invention. FIG. 3 is a schematic view showing the fixing device 10 according to the first embodiment of the present invention.

As shown in FIG. 1, the fixing device 10 includes the heating roller 13, the fixing roller 14, the fixing belt 11, the pressing roller 15, and the guide 71. A heater 16 is disposed in the heating roller 13 as a first heating member or a main heating member. A heater 17 is disposed in the fixing roller 14 as a second heating member or a fixing portion heating member. A heater 18 is disposed in the pressing roller 15 as a third heating member or a pressing member heating member.

The heater 16 heats the heating roller 13 and the fixing belt 11; the heater 17 heats the fixing roller 14; and the heater 18 heats the pressing roller 15, respectively. The heater 16 is disposed for preventing temperatures of the fixing belt 11 and the fixing roller 14 from decreasing, and mainly heats the fixing roller 14. The heater 17 heats the fixing roller 14 supplementarily. The fixing device 10 further includes a thermistor 19 as a first temperature detection unit disposed adjacent to or contacting with the heating roller 13 with the fixing belt 11 in between for detecting a first temperature representing a temperature of the fixing belt 11 (more precisely, a temperature of the heating roller 13). The fixing device 10 also includes a thermistor 20 as a second temperature detection unit disposed adjacent to or contacting with the pressing roller 15 for detecting a second temperature representing a temperature of the pressing roller 15. The first temperature and the second temperature detected with the thermistors 19 and 20 are sent to a control unit 53.

A spring (not shown) urges the heating roller 13 in a direction away from the fixing roller 14, so that the fixing belt 11 receives an appropriate tension. The fixing roller 14 is formed of a core metal portion 14*a* as a base member having a cylindrical shape with a thin wall thickness; and an elastic layer 14*b* made of a porous silicone rubber with high temperature resistance for covering the core metal portion 14*a*. The heater 17 is disposed on a center axis of the core metal portion 14*a*.

The fixing roller 14 is integrally provided with a gear (not shown) engaging a unit drive gear (not shown) disposed on a main body of the printer 60. When the unit drive gear rotates, the fixing roller 14 rotates in an arrow direction a, so that the fixing belt 11 moves in an arrow direction b and the heating roller 13 rotates in an arrow direction c.

While the fixing belt 11 moves, the pressing roller 15 follows with the fixing belt 11 and rotates in an arrow direction d. A spring (not shown) as an urging member urges the pressing roller 15 toward the fixing roller 14, so that the pressing roller 15 is pressed against the fixing roller 14 with the fixing belt 11 in between. Accordingly, a nip portion N is formed between the fixing roller 14 and the pressing roller 15. The guide 71 is disposed at an upstream side of the nip portion N in the direction that the fixing belt 11 moves, so that the guide 71 guides a sheet P transported from the main body of the printer in an arrow direction e to the nip portion N.

It is preferred that the fixing belt 11 is extended with the heating roller 13 with a tension between 1 kgf and 3 kgf at each end portion thereof. In the embodiment, the fixing belt 11 is extended with a tension of 3 kgf at each end portion thereof. The fixing belt 11 is formed of a base member formed of nickel and having a thickness of 100 μm and an elastic layer formed on the base member and made of a silicone rubber with a thickness of 200 μm. A fluorine tube with a thickness of 30 μm is formed on the elastic layer as a release layer, so that the fixing belt 11 has a small heat capacity and high thermal response. The base member may be formed of polyimide, and may have a thickness between 30 μm and 150 μm. The elastic layer formed of a silicone rubber may have a thickness between 10 μm and 100 μm. The release layer may be formed of a fluorine coating instead of the fluorine tube.

It is necessary to heat the fixing belt 11 relatively quickly to an extent that hot offset does not occur. At the same time, the fixing belt 11 needs to have a sufficient hear capacity for heating and melting toner of a toner image for fixing. In the embodiment, the fixing belt 11 with the structure (material and thickness) described above meets these requirements.

In the embodiment, the heating roller 13 and the pressing roller 15 have core metal portions having a cylindrical shape with a thin wall thickness similar to that of the fixing roller 14. The core metal portion of the heating roller 13 has an outer diameter between 20 mm and 30 mm and a thickness between 0.3 mm and 2.0 mm. The core metal portion 14*a* of the fixing roller 14 has an outer diameter between 20 mm and 50 mm and a thickness between 0.3 mm and 2.0 mm. A core metal portion 15*a* of the pressing roller 15 has an outer diameter between 20 mm and 50 mm and a thickness between 0.3 mm and 2.0 mm.

In the embodiment, the core metal portion of the heating roller 13 is formed of aluminum, and has an outer diameter of 30 mm and a thickness of 1.5 mm. The core metal portion of the heating roller 13 is preferably formed of a material having a small specific heat and a large thermal conductivity. The material includes metal such as iron, copper, and stainless steel in addition to aluminum. The heater 17 heats the fixing belt 11 through the heating roller 13 as well as the heating roller 13, so that the nip portion N has a temperature of 150° C.

In the embodiment, the core metal portion 14*a* of the fixing roller 14 is formed of iron, and has an outer diameter of 25 mm and a thickness of 1.5 mm. The core metal portion 14*a* is preferably formed of a material having a small specific heat and a large thermal conductivity. The material includes metal such as copper and stainless steel in addition to iron. The elastic layer 14*b* of the fixing roller 14 has a rubber hardness of 30° according to Asker C hardness, and may be in the range of 10° to 50°. The elastic layer 14*b* of the fixing roller 14 has a thickness in the range of 1 mm and 10 mm (5 mm in the embodiment). Accordingly, the fixing roller 14 has an outer diameter of 35 mm. The elastic layer 14*b* of the fixing roller 14 has a relatively low hardness and a large thickness. Accordingly, it is possible to obtain a sufficient nip width even with a low pressing force of the fixing roller 14, thereby obtaining good fixing performance even in a relatively low temperature and a relatively low pressure. As described above, the heating roller 13 has a heat capacity larger than that of the fixing roller 14.

The pressing roller 15 is formed of the core metal portion 15*a*; an elastic layer 15*b* formed on the core metal portion 15*a*; and a release layer (not shown) formed on the elastic layer 15*b*. The core metal portion 15*a* has an outer diameter of 30 mm and a thickness of 1.0 mm. The elastic layer 15*b* is formed of a silicone rubber, and has a thickness of 2.0 mm. A fluorine tube with a thickness of 30 μm is formed on the elastic layer 15*b* as the release layer, so that the pressing roller 15 has a small heat capacity and high thermal response. Accordingly, the pressing roller 15 has an outer diameter of about 34 mm.

The core metal portion 15*a* is preferably formed of a material having a small specific heat and a large thermal conductivity. The material includes metal such as iron, copper, and stainless steel. The release layer may have a thickness between 10 μm and 100 μm, and may be formed of a fluorine coating instead of the fluorine tube. Note that it is not necessary to provide the elastic layer 15*b*. It is preferred to provide the release layer regardless of the elastic layer 15*b*.

In the embodiment, the heater 16 is connected to a power source 51 as a voltage applying device through a triac 52 as a first application control unit. Further, the heater 17 and the heater 18 are connected to the power source 51 as a voltage applying device through a triac 54 as a second application control unit. The power source 51 applies a voltage of 100 V to the heater 16, the heater 17, and the heater 18 for heating.

The heater 16 has a rated output $P_1$; the heater 17 has a rated output $P_2$; and the heater 18 has a rated output $P_3$. In the fixing device 10, when it is tried to increase fixing performance, it is necessary to decrease the rated outputs $P_2$ and $P_3$ relative to the rated output $P_1$. When it is tried to save power consumption, it is necessary to further decrease the rated output $P_3$ relative to the rated output $P_2$. Further, when the fixing belt 11 moves at a high speed, since the sheet P acts as an insulating member, it is difficult to supply heat of the pressing roller 15 from a backside of the sheet P to a front side thereof. Accordingly, it is arranged such that heat of the fixing roller 14 is supplied to the front side of the sheet P. Therefore, the rated output $P_2$ is greater than the rated output $P_3$, and the rated outputs $P_1$ to $P_3$ have the following relationship.

$$P_1 > P_2 \geqq P_3$$

In general, when it is tried to reduce an output of a heater, it is necessary to increase a resistance of the heater, thereby increasing a wire diameter of the heater. In this case, when the heater is energized, the heater may deform downwardly with its own weight, thereby contacting with a glass tube or causing brakeage of the wire. Alternatively, it may be tried to reduce duty of the heater, thereby decreasing an output thereof. In this case, it is necessary to frequently switch the heater on and off, thereby shortening a life of the heater. Further, it may be tried to vary a voltage of the power source 51 and supply a low voltage to the heater. In this case, it is necessary to make structures of the fixing device 10 and the control unit 53 complex.

To this end, in the embodiment, the heater 17 and the heater 18 are connected to the power source 51 in series. When the fixing device 10 has a rated voltage of 100 V, it is configured such that the heater 16 has the rated output $P_1$ of 600 W; the heater 17 has a rated voltage of 62.5 V and the rated output $P_2$ of 150 W; and the heater 18 has a rated voltage of 37.5 V and the rated output $P_3$ of 150 W. That is, the heater 17 and the heater 18 have the low rated voltages, thereby preventing wire diameters of the heater 17 and the heater 18 from increasing. Further, the heater 17 and the heater 18 are connected to the power source 51 in series, thereby reducing the rated outputs $P_2$ and $P_3$.

In the embodiment, the heater 16 functions as a main heater, and the heater 17 and the heater 18 connected to the power source 51 in series function as sub-heaters having the rated outputs of 400 W (250+150). A total of the rated outputs $P_1$ to $P_3$ is adapted to be 1000 W considering a startup time and allowable power of the fixing device 10. As described above, in the embodiment, it is possible to reduce the rated outputs $P_2$ and $P_3$, thereby improving fixing performance.

A power control process unit (not shown) of the control unit 53 performs a power control process. That is, the power control process unit compares the first temperature with a set temperature of 175° C. When the first temperature exceeds 175° C., the power control process unit controls power of the power source 51 supplied to the heater 16. In particular, the power control process unit turns off a signal to the triac 52, thereby terminating the voltage supplied to the heater 16. Further, the power control process unit compares the second temperature with a set temperature of 150° C. When the second temperature exceeds 150° C., the power control process unit controls power of the power source 51 supplied to the heater 17 and the heater 18. In particular, the power control process unit turns off a signal to the triac 54, thereby terminating the voltages supplied to the heater 17 and the heater 18.

In the embodiment, the thermistor 20 is provided in the pressing roller 15 having the thermal response higher than that of the fixing roller 14. It is arranged such that power of the power source 51 supplied to the heater 17 and the heater 18 is controlled simultaneously according to the second temperature detected with the thermistor 20, thereby increasing the thermal response in the temperature control.

As shown in FIG. 3, a thermostat 13T is disposed to face the heating roller 13 for detecting a temperature of the heating roller 13. A thermostat 14T is disposed to face the fixing roller 14 for detecting a temperature of the fixing roller 14. A thermostat 15T is disposed to face the pressing roller 15 for detecting a temperature of the pressing roller 15. The thermostats 13T to 15T constitute temperature detection units, respectively.

An operation of the fixing device 10 will be explained next. After the printer 60 (FIG. 2) is turned on, and the heaters 16 to 18 are powered on, when the first temperature reaches 175° C., the startup of the fixing belt 11 is completed. Further, when the second temperature reaches 150° C., the startup of the fixing roller 14 and the pressing roller 15 is completed. When the first temperature becomes a specific temperature, the fixing belt 11 starts to move, so that the fixing belt 11 has a uniform temperature. When the first temperature reaches 175° C., the fixing belt 11 stops moving.

When the printing operation starts, the fixing belt 11 starts to move. At this time, since the heater 17 is disposed in the fixing roller 14, the temperatures of the heating roller 13 and the fixing belt 11 do not decrease rapidly (under shoot) due to heat transferring from the heating roller 13 and the fixing belt 11 to the fixing roller 14. Further, since the heater 17 is disposed in the fixing roller 14, and the rated output $P_2$ is larger than the rated output $P_3$, it is possible to set the temperature of the fixing roller 14 higher than that of the pressing roller 15 after the startup. Accordingly, it is possible to prevent the temperature of the fixing belt 11 receiving heat from the heating roller 13 and the fixing roller 14 from decreasing. As a result, the temperature of the fixing belt 11 becomes stable, thereby preventing the temperature of the heating roller 13 from decreasing rapidly and eliminating a fixing problem.

When the heater 17 is disposed in the fixing roller 14, since the fixing roller 14 has a large heat capacity and low thermal response, it is necessary to consider over shoot in which the temperature increases rapidly right after sheets continuously pass through. In the embodiment, it is arranged such that the rated output $P_2$ is smaller than the rated output $P_1$ by a difference between the heat capacities of the fixing roller 14 and the heating roller 13, thereby reducing the over shoot of the temperature of the fixing roller 14. Further, it is arranged such that the pressing roller 15 has a temperature lower than that of the fixing roller 14. Accordingly, after sheets continuously pass through, the pressing roller 15 rotates to transfer heat from the fixing roller 14 to the pressing roller 15, thereby reducing the over shoot of the temperature of the fixing roller 14.

Figure 4:
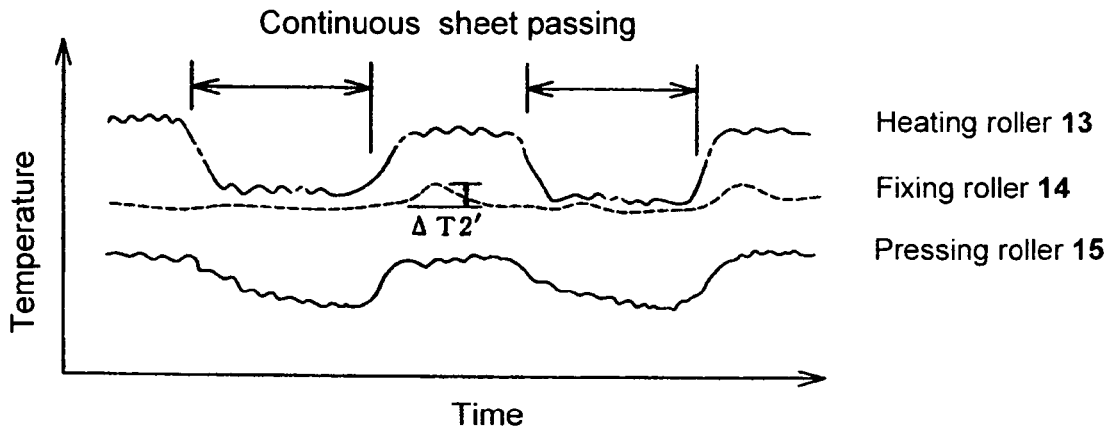
FIG. 4 is a graph showing a temperature change in each of rollers of the fixing device according to the first embodiment of the present invention.
Figure 5:
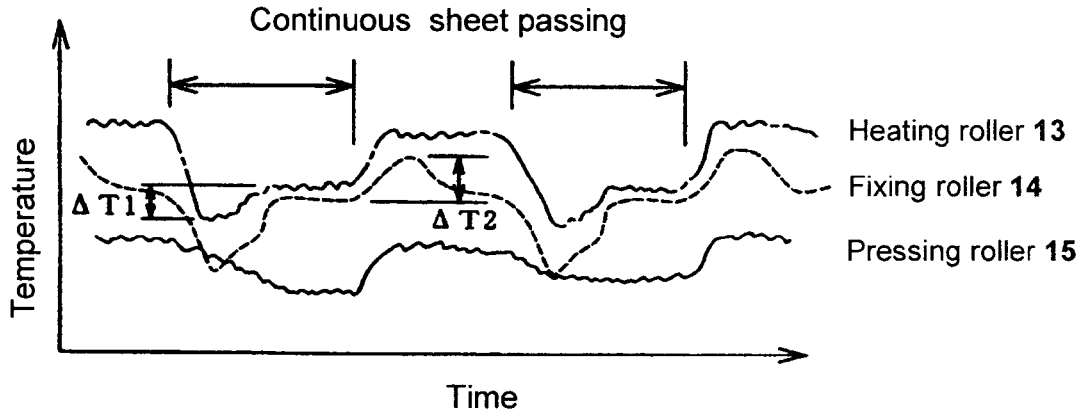
FIG. 5 is a graph showing a temperature change in each of rollers of a conventional fixing device.

FIG. 4 is a graph showing a temperature change in each of rollers of the fixing device according to the first embodiment of the present invention. FIG. 5 is a graph showing a temperature change in each of rollers of a conventional fixing device. In FIGS. 4 and 5, the horizontal axis represents a time, and the vertical axis represents a temperature.

As shown in FIG. 4, in the embodiment, it is possible to prevent the temperature of the heating roller 13 from rapidly decreasing after the startup, and also possible to prevent the temperature of the fixing roller 14 from rapidly increasing after the sheets pass through consecutively. In FIGS. 4 and 5, ΔT1 represents under shoot of the temperature of the heating roller 13 after the startup in the conventional fixing device; ΔT2 represents over shoot of the temperature of the fixing roller 14 after the sheets pass through consecutively in the conventional fixing device; and ΔT2' represents over shoot of the temperature of the fixing roller 14 after the sheets pass through consecutively in the fixing device according to the first embodiment of the present invention.

As described above, in the embodiment, without providing a complex structure for controlling the temperatures, it is possible to prevent the temperature of the fixing belt 11 from decreasing through the contact with the fixing roller 14, and also possible to prevent the temperature of the fixing roller 14 from decreasing rapidly, thereby preventing a fixing problem.

Second Embodiment

A second embodiment of the present invention will be explained next. Components same as those in the first embodiment are designated with the same numeral references, and explanations thereof are omitted. The components same as those in the first embodiment provide the same effects.

Figure 6:
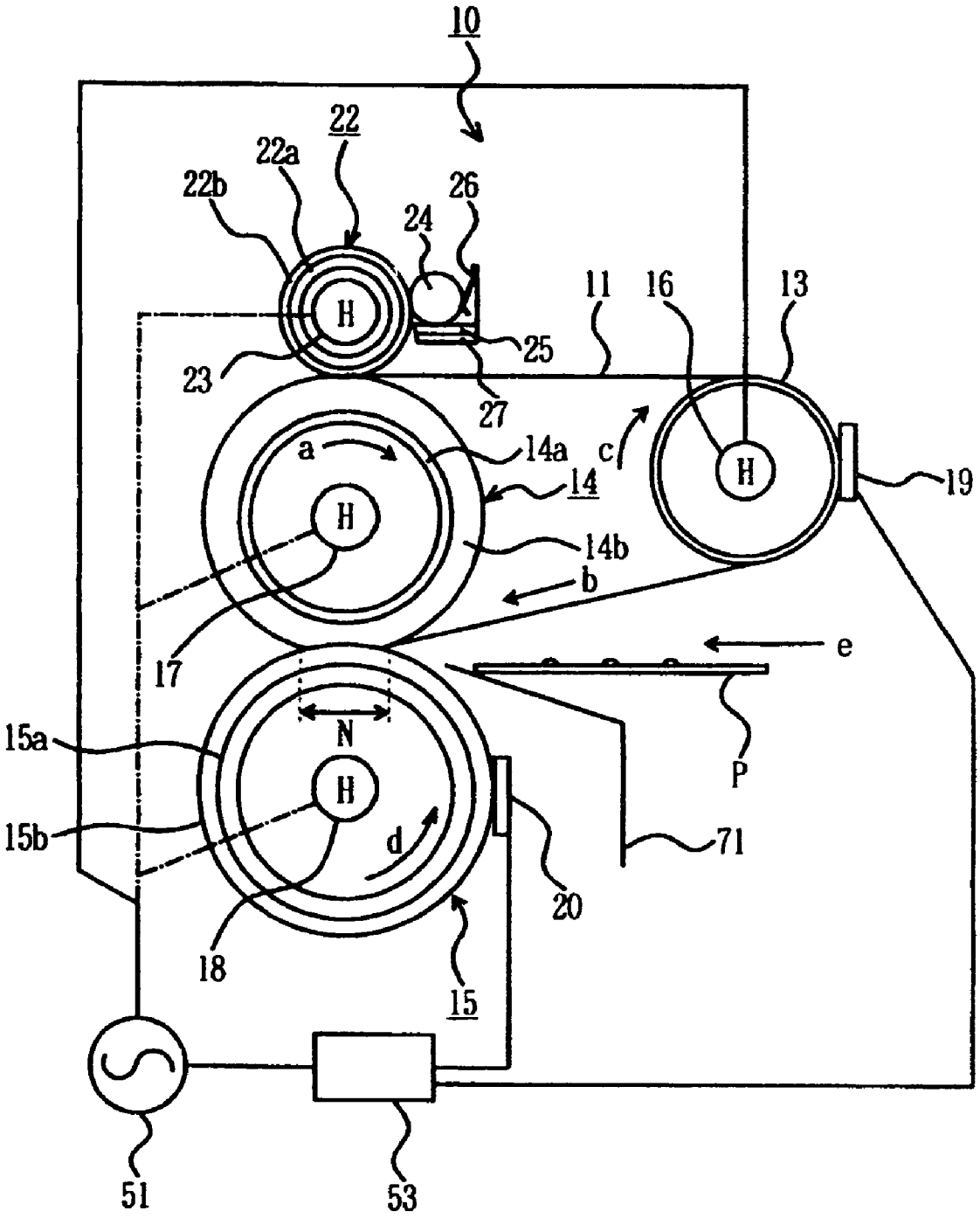
FIG. 6 is a schematic side view showing a fixing device according to a second embodiment of the present invention.

FIG. 6 is a schematic side view showing a fixing device 10 according to the second embodiment of the present invention. As shown in FIG. 6, the fixing device 10 is provided with a release agent coating roller 22 abutting against the fixing belt 11 for supplying a release agent 27 containing silicone oil as a major component to the fixing belt 11. Accordingly, it is possible to easily detach the sheet P as the recording medium from the fixing belt 11 as the belt member after the toner image is fixed.

The release agent coating roller 22 is formed of a core metal portion 22*a* as a base member having a cylindrical shape with a thin wall thickness; and an elastic layer 22*b* made of a porous silicone rubber with high temperature resistance for covering the core metal portion 22*a*. A heater 23 is disposed as a fourth heating member on a center axis of the core metal portion 22*a*. The release agent coating roller 22 is disposed at a position to abut against the fixing roller 14 as the fixing member or the second rotational member with the fixing belt 11 in between, so that the release agent coating roller 22 rotates while accompanying with the fixing belt 11. The release agent coating roller 22 constitutes a temperature compensation member for compensating the temperature of the fixing roller 14, and the heater 23 constitutes a temperature compensation member heating member.

The release agent coating roller 22 includes a supply gear (not shown) driven by the unit drive gear; a supply roller 24 as a release agent supply member driven together with the supply gear; a felt 25 as a release agent supply source for supplying the release agent 27 to the supply roller 24; a release agent control blade 26 as a thickness control member for leveling a layer of the release agent 27; a spring (not shown) as an urging member for urging the supply roller 24 against the release agent coating roller 22; and a spring (not shown) as an urging member for urging the fixing belt 11 against the release agent coating roller 22 with a specific force.

In the embodiment, the heater 16 as the main heating member, the heater 17 as the second heating member or the fixing member heating member, the heater 18 as the third heating member or the pressing member heating member, and the heater 23 are directly connected to the power source 51. The power source 51 applies a voltage to the heaters 16, 17, 18, and 23 for heating.

The heater 16 has the rated output $P_1$; the heater 17 has the rated output $P_2$; the heater 18 has the rated output $P_3$; and the heater 23 has a rated output $P_4$. When the fixing device 10 has a rated voltage of 100 V, it is configured such that the rated output $P_1$ is 600 W; the rated output $P_2$ is 200 W; the rated output $P_3$ is 150 W; and the rated output $P_4$ is 50 W. Accordingly, the rated outputs $P_1$ to $P_4$ have the following relationship.

$$P_1>P_2\geqq P_3>P_4$$

In the embodiment, the heater 17, the heater 18, and the heater 23 are connected to the power source 51 in series (indicated by a projected line in FIG. 6). A total of the rated outputs $P_1$ to $P_4$ is adapted to be 1000 W considering a startup time and allowable power of the fixing device 10.

The thermistor 19 as the first temperature detection unit is disposed adjacent to or contacts with the heating roller 13 as the heating member or the first rotational member; and the thermistor 20 as the second temperature detection unit is disposed adjacent to or contacts with the pressing roller 15 as the pressing member or the third rotational member. The first temperature representing the temperature of the fixing belt 11 and the second temperature representing the temperature of the pressing roller 15 respectively detected with the thermistors 19 and 20 are sent to the control unit 53. In the embodiment, the heating roller 13, the fixing roller 14, and the fixing belt 11 constitute the fixing member.

The power control process unit of the control unit 53 compares the first temperature with a set temperature of 175° C. When the first temperature exceeds 175° C., the power control process unit controls power of the power source 51 supplied to the heater 16. In particular, the power control process unit turns off a signal to the triac 52 (FIG. 3), thereby terminating the voltage supplied to the heater 16. Further, the power control process unit compares the second temperature with a set temperature of 150° C. When the second temperature exceeds 150° C., the power control process unit turns off a signal to the triac 54 as the second application control unit, thereby terminating the voltages supplied from the power source 51 to the heater 17, the heater 18, and the heater 23.

In the embodiment, the thermistor 20 is provided in the pressing roller 15 having the thermal response higher than those of the fixing roller 14 and the release agent coating roller 22. It is arranged such that the power of the power source 51 supplied to the heater 17, the heater 18, and the heater 23 is controlled simultaneously according to the second temperature detected with the thermistor 20, thereby increasing the thermal response in the temperature control.

The release agent coating roller 22 has a heat capacity smaller than those of the fixing roller 14 and the pressing roller 15. Accordingly, the rated output $P_4$ becomes smaller than the rated outputs $P_2$ and $P_3$. In the second embodiment, it is configured such that a sum of the rated outputs $P_2$ and $P_4$ is equal to the rated output $P_2$ in the first embodiment. Accordingly, it is possible to make the heat capacity of the fixing belt 11 equal to that in the first embodiment. In the embodiment, the heater 17, the heater 18, and the heater 23 are connected to the power source 51 in series. Accordingly, it is possible to reduce the rated outputs $P_2$ to $P_4$.

An operation of the fixing device 10 will be explained next. After the printer 60 (FIG. 2) is turned on, and the heaters 16 to 18, and 23 are powered on, when the first temperature reaches 175° C., the startup of the fixing belt 11 is completed. Further, when the second temperature reaches 150° C., the startup of the fixing roller 14, the pressing roller 15, and the heater 23 is completed. When the first temperature becomes a specific temperature, the fixing belt 11 starts to move, so that the fixing belt 11 has a uniform temperature. When the first temperature reaches 175° C., the fixing belt 11 stops moving.

When the printing operation starts, the fixing belt 11 starts to move. At this time, since the heater 17 and the heater 23 are disposed in the fixing roller 14 and the release agent coating roller 22, respectively, the temperatures of the heating roller 13 and the fixing belt 11 do not decrease rapidly due to heat transferring from the heating roller 13 and the fixing belt 11 to the fixing roller 14 and the release agent coating roller 22. In this case, the release agent coating roller 22 is disposed at an upstream side of the thermistor 19 in the moving direction of the fixing belt 11. Accordingly, as compared with a case that the release agent coating roller 22 is arranged to abut against the heating roller 13, it is possible to reduce an influence of temperature fluctuation generated in the release agent coating roller 22 on the temperature control and the printing operation.

The release agent coating roller 22 rotates while accompanying with the fixing belt 11. When the supply gear 24 rotates with the rotation of the supply gear, the felt 25 supplies the release agent 27 to the supply roller 24. Then, the release agent control blade 26 adjusts the thickness of the release agent 27, and the release agent coating roller 22 uniformly supplies the release agent 27 to the fixing belt 11 in a proper amount.

As described above, in the embodiment, the release agent coating roller 22 is provided for supplying the release agent 27 to the fixing belt 11. Accordingly, it is possible to easily detach the sheet P as the recording medium from the fixing belt 11 as the belt member after the toner image is fixed. Further, without providing a complex structure for controlling the temperatures, it is possible to prevent the temperature of the fixing belt 11 from decreasing through the contact with the fixing roller 14 and the release agent coating roller 22, thereby preventing a fixing problem.

Third Embodiment

A third embodiment of the present invention will be explained next. Components same as those in the first embodiment are designated with the same numeral references, and explanations thereof are omitted. The components same as those in the first embodiment provide the same effects.

Figure 7:
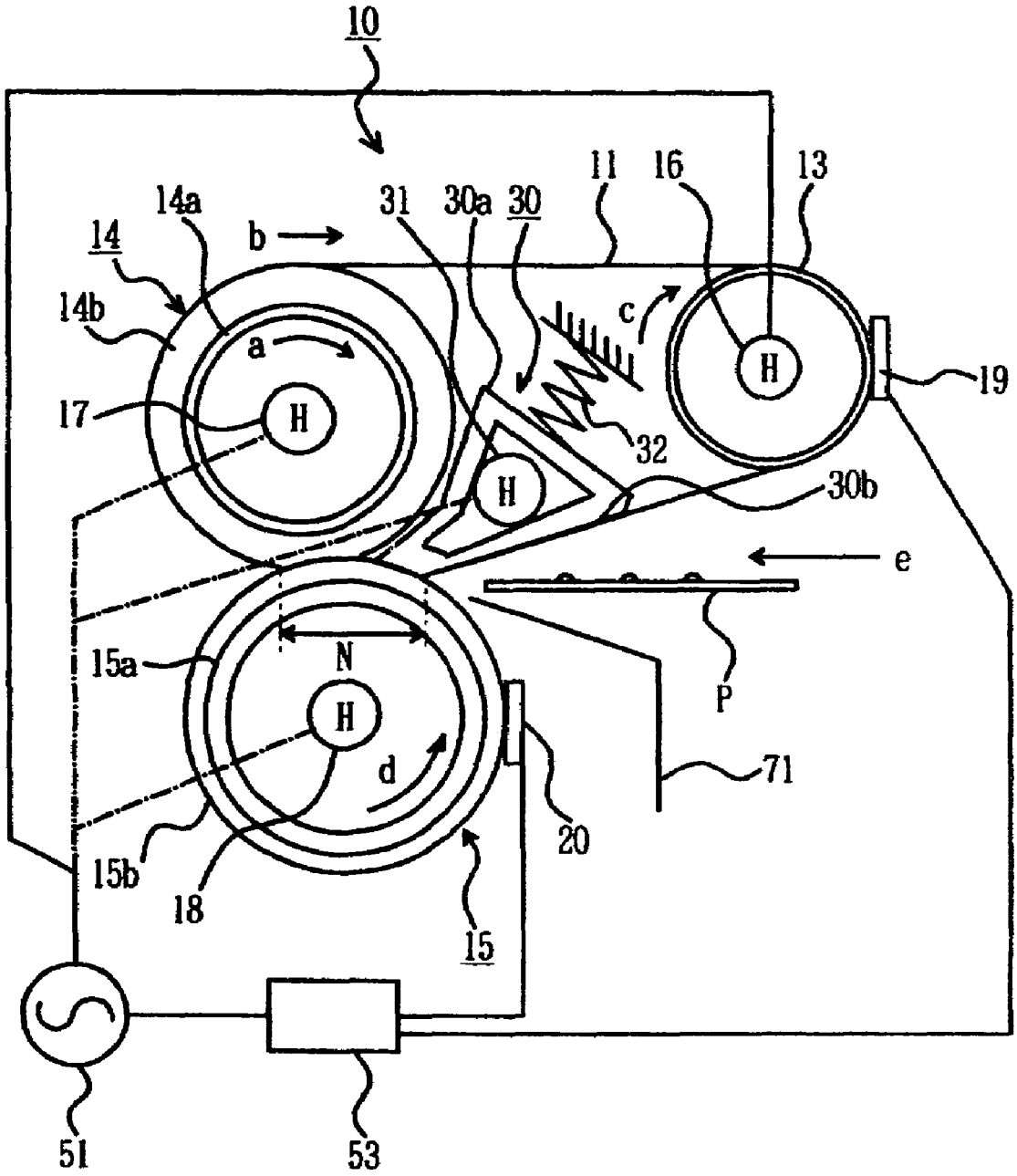
FIG. 7 is a schematic side view showing a fixing device according to a third embodiment of the present invention.

FIG. 7 is a schematic side view showing a fixing device 10 according to the third embodiment of the present invention. As shown in FIG. 7, the fixing device 10 is provided with a pushing member 30 at an upstream side of the fixing roller 14 as the fixing member or the second rotational member in the moving direction of the fixing belt 11. The pushing member 30 is disposed inside the fixing belt 11 while contacting therewith. Accordingly, it is possible to stay the sheet P as the recording medium at the nip portion N as the fixing area for a long period of time, even when a printing speed is increased.

The pushing member 30 is formed of a hollow member 30*a* made of an extruded aluminum base member; and a sliding coating layer 30*b* made of a silicone or a fluorine base member coated on a surface thereof contacting with an inner surface of the fixing belt 11 for reducing friction relative to the fixing belt 11. A heater 31 is disposed as a fifth heating member in the pushing member 30. The sliding coating layer 30*b* may be replaced with a glass cloth coated with a fluorine coating. The pushing member 30 constitutes a temperature compensation member for compensating the temperature of the fixing roller 14, and the heater 31 constitutes a temperature compensation member heating member.

A spring 32 urges the pushing member 30 against the pressing roller 15 as the pressing member or the third rotational member with a specific force through the fixing belt 11. It is arranged such that the pushing member 30 is pressed against the pressing roller 15 at the nip portion N with a specific force between 0.5 kgf/cm$^2$ and 1.5 kgf/cm$^2$ through the fixing belt 11, thereby performing proper fixing.

Note that when the pushing member 30 contacts with the fixing roller 14, a motor as a driving unit for rotating the fixing roller 14 receives an excess load. Further, when the pushing member 30 is away from the fixing roller 14 for a large distance, the pressing roller 15 is not pressed over a sufficient area. In this case, a problem such as an image shift may occur due to a difference between a moving speed of the fixing belt 11 and a circumferential speed of the pressing roller 15. Accordingly, it is arranged such that the pushing member 30 does not contact with the fixing roller 14, and is away from the fixing roller 14 for a minimum distance.

In the embodiment, the heater 16 as the main heating member, the heater 17 as the second heating member or the fixing member heating member, the heater 18 as the third heating member or the pressing member heating member, and the heater 31 are directly connected to the power source 51. The power source 51 applies a voltage to the heaters 16, 17, 18, and 31 for heating.

The heater 16 has the rated output $P_1$; the heater 17 has the rated output $P_2$; the heater 18 has the rated output $P_3$; and the heater 31 has a rated output $P_4$. When the fixing device 10 has a rated voltage of 100 V, it is configured such that the rated output $P_1$ is 600 W; the rated output $P_2$ is 200 W; the rated output $P_3$ is 150 W; and the rated output $P_4$ is 50 W. Accordingly, the rated outputs $P_1$ to $P_4$ have the following relationship.

$$P_1 > P_2 \geqq P_3 > P_4$$

In the embodiment, the heater 17, the heater 18, and the heater 31 are connected to the power source 51 in series (indicated by a projected line in FIG. 7). A total of the rated outputs $P_1$ to $P_4$ is adapted to be 1000 W considering a startup time and allowable power of the fixing device 10.

The thermistor 19 as the first temperature detection unit is disposed adjacent to or contacts with the heating roller 13 as the heating member or the first rotational member; and the thermistor 20 as the second temperature detection unit is disposed adjacent to or contacts with the pressing roller 15 as the pressing member or the third rotational member. The first temperature representing the temperature of the fixing belt 11 and the second temperature representing the temperature of the pressing roller 15 respectively detected with the thermistors 19 and 20 are sent to the control unit 53. In the embodiment, the heating roller 13, the fixing roller 14, and the fixing belt 11 constitute the fixing member.

The power control process unit of the control unit 53 compares the first temperature with a set temperature of 175° C. When the first temperature exceeds 175° C., the power control process unit turns off a signal to the triac 52 (FIG. 3), thereby terminating the voltage supplied from the power source 51 to the heater 16. Further, the power control process unit compares the second temperature with a set temperature of 150° C. When the second temperature exceeds 150° C., the power control process unit turns off a signal to the triac 54 as the second application control unit, thereby terminating the voltages supplied from the power source 51 to the heater 17, the heater 18, and the heater 31.

In the embodiment, the thermistor 20 is provided in the pressing roller 15 having the thermal response higher than those of the fixing roller 14 and the release agent coating roller 22. It is arranged such that the power of the power source 51 supplied to the heater 17, the heater 18, and the heater 31 is controlled simultaneously according to the second temperature detected with the thermistor 20, thereby increasing the thermal response in the temperature control.

The pushing member 30 has a heat capacity smaller than those of the fixing roller 14 and the pressing roller 15. Accordingly, the rated output $P_4$ becomes smaller than the rated outputs $P_2$ and $P_3$. In the embodiment, it is configured such that a sum of the rated outputs $P_2$ and $P_4$ is equal to the rated output $P_2$ in the first embodiment. Accordingly, it is possible to make the heat capacity of the fixing belt 11 equal to that in the first embodiment. In the embodiment, the heater 17, the heater 18, and the heater 31 are connected to the power source 51 in series. Accordingly, it is possible to reduce the rated outputs $P_2$ to $P_4$.

An operation of the fixing device 10 will be explained next. After the printer 60 (FIG. 2) is turned on, and the heaters 16 to 18, and 31 are powered on, when the first temperature reaches 175° C., the startup of the fixing belt 11 is completed. Further, when the second temperature reaches 150° C., the startup of the pressing roller 15 is completed. When the first temperature becomes a specific temperature, the fixing belt 11 starts to move, so that the fixing belt 11 has a uniform temperature. When the first temperature reaches 175° C., the fixing belt 11 stops moving.

When the printing operation starts, the fixing belt 11 starts to move. At this time, since the heater 17 and the heater 31 are disposed in the fixing roller 14 and the pushing member 30, respectively, the temperatures of the heating roller 13 and the fixing belt 11 do not decrease rapidly due to heat transferring from the heating roller 13 and the fixing belt 11 to the fixing roller 14 and the pushing member 30.

As described above, in the embodiment, the pushing member 30 is provided inside the fixing belt 11. Accordingly, it is possible to supply sufficient heat for the fixing to the sheet P as a recording medium, thereby increasing a printing speed. Further, without providing a complex structure for controlling the temperatures, it is possible to prevent the temperature of the fixing belt 11 from decreasing through the contact with the fixing roller 14 and the pushing member 30, thereby preventing a fixing problem.

Fourth Embodiment

A fourth embodiment of the present invention will be explained next. Components same as those in the first and second embodiments are designated with the same numeral references, and explanations thereof are omitted. The components same as those in the first and second embodiments provide the same effects.

Figure 8:
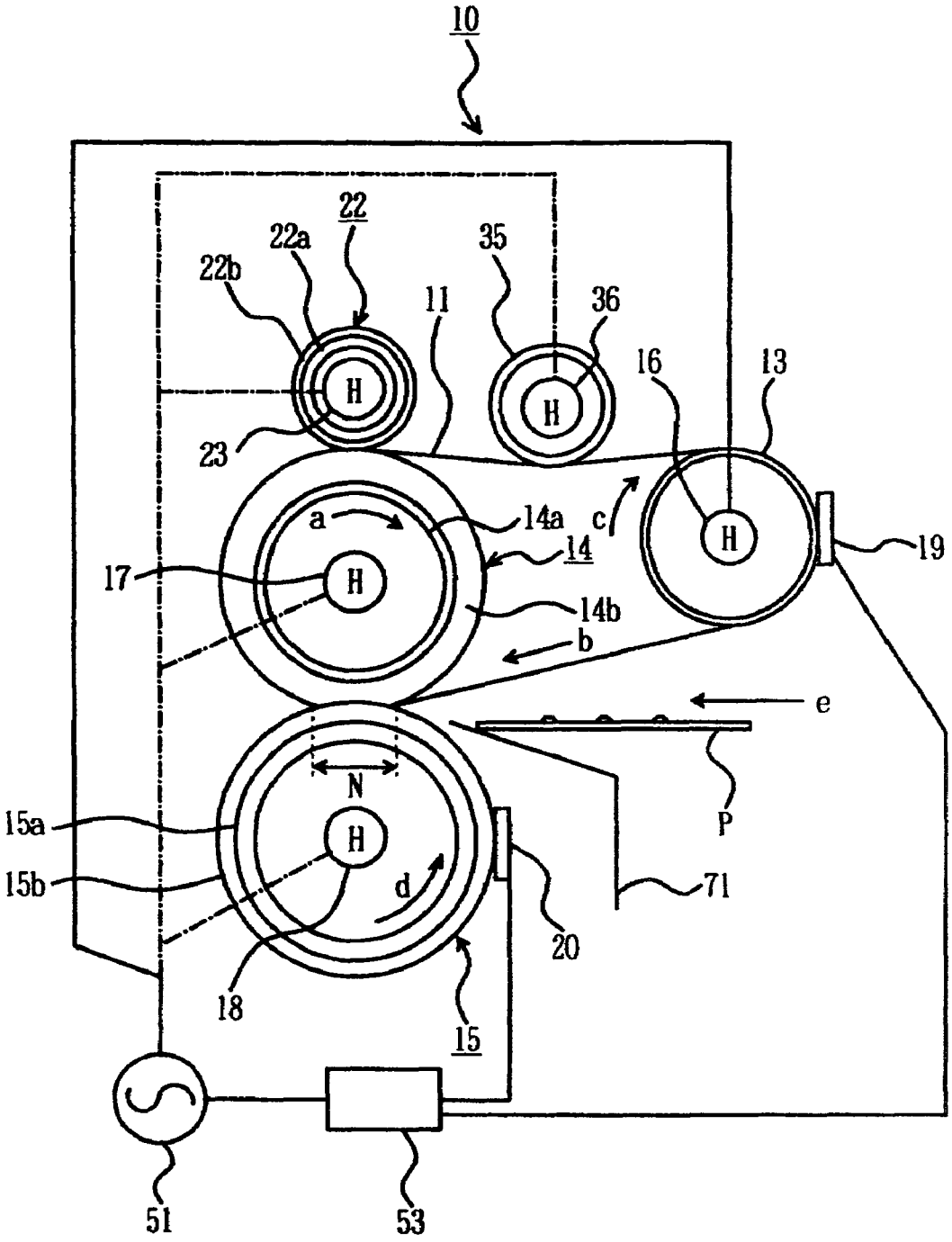
FIG. 8 is a schematic side view showing a fixing device according to a fourth embodiment of the present invention.

FIG. 8 is a schematic side view showing a fixing device 10 according to the fourth embodiment of the present invention. As shown in FIG. 8, the fixing device 10 is provided with a tension roller 35 elastically contacting with the fixing belt 11 at a downstream side of the fixing roller 14 as the fixing member or the second rotational member and an upstream side of the heating roller 13 as the heating member or the first rotational member in the moving direction of the fixing belt 11. Accordingly, it is possible to prevent the fixing belt 11 as the belt member from shifting.

The tension roller 35 is extended with a tension of 3 kgf on one side thereof relative to the fixing belt 11. It is possible to adjust the tension in a range between 1 kgf and 3 kgf by changing a position of the tension roller 35. Accordingly, it is possible to stably move the fixing belt 11. Note that the heating roller 13, the fixing roller 14, and the fixing belt 11 constitute the fixing member.

The tension roller 35 is formed of a cylindrical core metal member made of aluminum. The core metal member has an outer diameter between 15 mm and 30 mm, and a wall thickness between 0.3 mm and 1.5 mm. In the embodiment, the outer diameter is 20 mm, and the wall thickness is 1.0 mm. A heater 36 is provided on a center axis of the core metal member as a sixth heating member.

The release agent coating roller 22 is disposed at a position contacting with the fixing roller 14 through the fixing belt 11. The release agent coating roller 22 is provided with the supply roller 24 (FIG. 6) as a release agent supply member; the felt 25 as a release agent supply source; the release agent control blade 26 as a thickness control member; and the release agent 27. The release agent coating roller 22 and the tension roller 35 constitute a temperature compensation member for compensating the temperature of the fixing roller 14. The heater 23 as the fourth heating member and the heater 36 constitute a temperature compensation member heating member. The release agent coating roller 22 constitutes a first compensation member, and the tension roller 35 constitutes a second compensation member. The heater 23 constitutes a first temperature compensation member heating member, and the heater 36 constitutes a first temperature compensation member heating member.

In the embodiment, the heater 16 as the main heating member, the heater 17 as the second heating member or the fixing member heating member, the heater 18 as the third heating member or the pressing member heating member, and the heaters 23 and 36 are directly connected to the power source 51. The power source 51 applies a voltage to the heaters 16, 17, 18, 23, and 36 for heating.

The heater 16 has the rated output $P_1$; the heater 17 has the rated output $P_2$; the heater 18 has the rated output $P_3$; the heater 23 has the rated output $P_5$; and the heater 36 has a rated output $P_6$. When the fixing device 10 has a rated voltage of 100 V, it is configured such that the rated output $P_1$ is 600 W; the rated output $P_2$ is 170 W; the rated output $P_3$ is 150 W; the rated output $P_5$ is 50 W; and the rated output $P_6$ is 30 W. Accordingly, the rated outputs $P_1$ to $P_3$, $P_5$ and $P_6$ have the following relationship.

$$P_1>P_2\geqq P_3>P_5>P_6$$

In the embodiment, the heater 17, the heater 18, the heater 23, and the heater 36 are connected to the power source 51 in series (in FIG. 8, the connection indicated by a projected line is parallel for convenience). A total of the rated outputs $P_1$ to $P_3$, $P_5$ and $P_6$ is adapted to be 1000 W considering a startup time and allowable power of the fixing device 10.

The thermistor 19 as the first temperature detection unit is disposed adjacent to or contacts with the heating roller 13 as the heating member or the first rotational member; and the thermistor 20 as the second temperature detection unit is disposed adjacent to or contacts with the pressing roller 15 as the pressing member or the third rotational member. The first temperature representing the temperature of the fixing belt 11 and the second temperature representing the temperature of the pressing roller 15 respectively detected with the thermistors 19 and 20 are sent to the control unit 53.

The power control process unit of the control unit 53 compares the first temperature with a set temperature of 175° C. When the first temperature exceeds 175° C., the power control process unit turns off a signal to the triac 52 (FIG. 3), thereby terminating the voltage supplied from the power source 51 to the heater 16. Further, the power control process unit compares the second temperature with a set temperature of 150° C. When the second temperature exceeds 150° C., the power control process unit turns off a signal to the triac 54 as the second application control unit, thereby terminating the voltages supplied from the power source 51 to the heater 17, the heater 18, the heater 23, and the heater 36.

In the embodiment, the thermistor 20 is provided in the pressing roller 15 having the thermal response higher than those of the fixing roller 14, the release agent coating roller 22, and the tension roller 35. It is arranged such that the power of the power source 51 supplied to the heater 17, the heater 18, the heater 23, and the heater 36 is controlled simultaneously according to the second temperature detected with the thermistor 20, thereby increasing the thermal response in the temperature control.

The tension roller 35 has a heat capacity smaller than those of the fixing roller 14, the pressing roller 15, and the release agent coating roller 22. Accordingly, the rated output $P_6$ becomes smaller than the rated outputs $P_2$, $P_3$, and $P_5$. In the second embodiment, it is configured such that a sum of the rated outputs $P_2$, $P_5$, and $P_6$ is equal to the rated output $P_2$ in the first embodiment. Accordingly, it is possible to make the heat capacity of the fixing belt 11 equal to that in the first embodiment. In the embodiment, the heater 17, the heater 18, the heater 23, and the heater 36 are connected to the power source 51 in series. Accordingly, it is possible to reduce the rated outputs $P_2$, $P_3$, $P_5$, and $P_6$.

An operation of the fixing device 10 will be explained next. After the printer 60 (FIG. 2) is turned on, and the heaters 16 to 18, 23, and 36 are powered on, when the first temperature reaches 175° C., the startup of the fixing belt 11 is completed. Further, when the second temperature reaches 150° C., the startup of the pressing roller 15 is completed. When the first temperature becomes a specific temperature, the fixing belt 11 starts to move, so that the fixing belt 11 has a uniform temperature. When the first temperature reaches 175° C., the fixing belt 11 stops moving.

When the printing operation starts, the fixing belt 11 starts to move. At this time, since the heaters 17, 23 and 36 are disposed in the fixing roller 14, the release agent coating roller 22, and the tension roller 35, respectively, the temperatures of the heating roller 13 and the fixing belt 11 do not decrease rapidly due to heat transferring from the heating roller 13 and the fixing belt 11 to the fixing roller 14, the release agent coating roller 22, and the tension roller 35.

As described above, in the embodiment, the tension roller 35 is provided for preventing the fixing belt 11 from shifting. Further, without providing a complex structure for controlling the temperatures, it is possible to prevent the temperature of the fixing belt 11 from decreasing through the contact with the fixing roller 14, the release agent coating roller 22, and the tension roller 35, thereby preventing a fixing problem.

Fifth Embodiment

A fifth embodiment of the present invention will be explained next. Components same as those in the first embodiment are designated with the same numeral references, and explanations thereof are omitted. The components same as those in the first embodiment provide the same effects.

Figure 9:
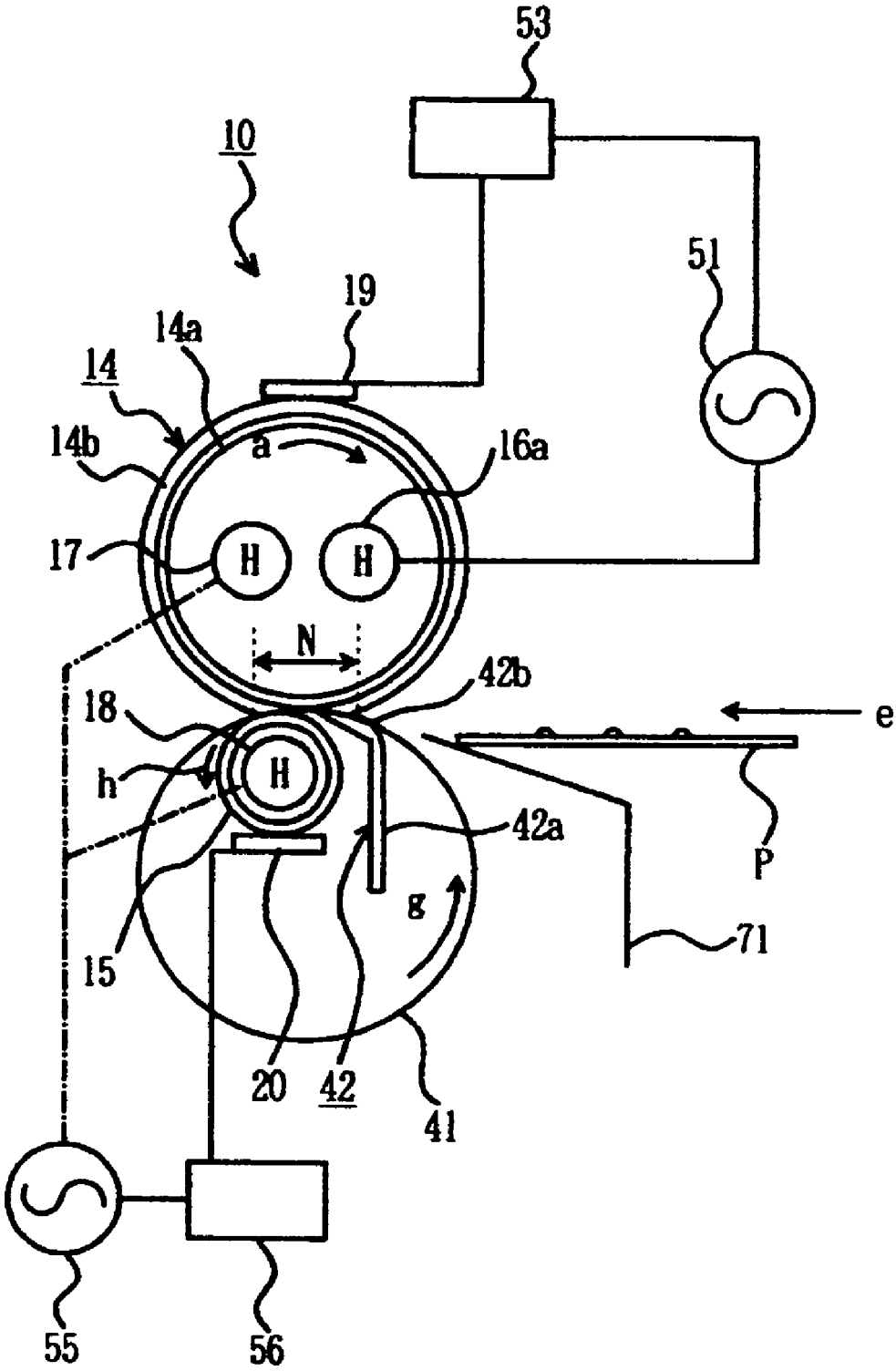
FIG. 9 is a schematic side view showing a fixing device according to a fifth embodiment of the present invention.

FIG. 9 is a schematic side view showing a fixing device 10 according to the fifth embodiment of the present invention. As shown in FIG. 9, the fixing device 10 is provided with the fixing roller 14 as the fixing member or the second rotational member; a pressing belt 41 as a pressing belt member; the pressing roller 15 as the pressing member or the third rotational member disposed to face the fixing roller 14 with the pressing belt 41 in between; a pushing member 42; a heater 16*a* disposed in the fixing roller 14 as the first heating member or the main heating member; the heater 17 as the second heating member or the fixing portion heating member; the heater 18 disposed in the pressing roller 15 as the third heating member or the pressing member heating member; and the guide 71.

A guide member (not shown) is provided for guiding the pressing belt 41 to move at a specific position between the fixing roller 14 and the pressing roller 15, so that the pressing belt 41 moves along the guide member.

The fixing roller 14 is integrally provided with a gear (not shown) engaging a unit drive gear (not shown). When the unit drive gear rotates, the fixing roller 14 rotates in an arrow direction a, so that the pressing belt 41 moves in an arrow direction g. The pressing roller 15 follows with the pressing belt 41 to rotate in an arrow direction h, and is urged toward the fixing roller 14 with a spring (not shown) as an urging member, so that the pressing roller 15 is pressed against the fixing roller 14 with the pressing belt 41 in between. The pushing member 42 is also urged toward the fixing roller 14 with a spring (not shown) as an urging member, so that the pushing member 41 is pressed against the fixing roller 14 with the pressing belt 41 in between. Accordingly, the nip portion N is formed between the fixing roller 14, and the pressing roller 15 and the pushing member 42.

The pressing belt 41 is formed of a base member made of polyimide and having a thickness between 90 μm. A release layer made of a fluorine coating is formed on the base member, thereby providing a low heat capacity and high heat responsiveness. The base member may be formed of stainless and having a thickness between 30 μm and 150 μm. The release layer may have a thickness between 10 μm and 100 μm, and may be coated with a fluorine tube.

In the embodiment, the fixing roller 14 and the pressing roller 15 have the core metal portions 14*a* and 15*a* having a cylindrical shape with a thin wall thickness. The core metal portion 14*a* of the fixing roller 14 has an outer diameter between 20 mm and 50 mm and a thickness between 0.3 mm and 2.0 mm. The core metal portion 15*a* of the pressing roller 15 has an outer diameter between 20 mm and 50 mm and a thickness between 0.3 mm and 2.0 mm.

In the embodiment, the core metal portion 14*a* of the fixing roller 14 is formed of iron, and has an outer diameter of 25.6 mm and a thickness of 1.0 mm. The core metal portion 14*a* is preferably formed of a material having a small specific heat and a large thermal conductivity. The material includes metal such as aluminum, copper, and stainless steel in addition to iron. The elastic layer 14*b* of the fixing roller 14 has a rubber hardness of 5° according to Asker C hardness, and may be in the range of 5° to 30°. The elastic layer 14*b* of the fixing roller 14 has a thickness in the range of 0.5 mm and 2 mm (1.2 mm in the embodiment). Accordingly, the fixing roller 14 has an outer diameter of 28 mm.

The pressing roller 15 is formed of the core metal portion 15*a*; the elastic layer 15*b* (FIG. 1) formed on the core metal portion 15*a*; and a sliding layer (not shown) formed on the elastic layer 15*b* for preventing the fixing roller 14 from shifting one side. In the embodiment, the core metal portion 15*a* has an outer diameter of 20 mm and a thickness of 1.5 mm. The elastic layer 15*b* is formed of a silicone rubber, and has a thickness of 0.5 mm. A fluorine coating with a thickness of 20 μm is formed on the elastic layer 15*b* as the sliding layer. Accordingly, the pressing roller 15 has an outer diameter of about 34 mm. The core metal portion 15*a* is preferably formed of a material having a low specific heat and a high heat conductivity, and including metal such as copper and stainless steel in addition to iron. It is not necessary to provide the elastic layer 15*b*, and is preferable to provide the sliding layer regardless of the elastic layer 15*b*.

The pushing member 42 is formed of a structural member 42*a* made of an extruded aluminum base member; and a sliding coating layer 42*b* made of a silicone or a fluorine base member coated on a surface thereof contacting with an inner surface of the pressing belt 41 for reducing friction relative to the pressing belt 41. The sliding coating layer 42*b* may be replaced with a glass cloth coated with a fluorine coating.

It is preferred such that the pushing member 42 is pressed against the fixing roller 14 with a specific force between 0.5 $kgf/cm^2$ and 1.5 $kgf/cm^2$, and the pressing roller 15 is pressed against the fixing roller 14 with a specific force between 2.0 $kgf/cm^2$ and 3.0 $kgf/cm^2$.

In the embodiment, the nip portion N is formed between the fixing roller 14, and the pressing roller 15 and the pushing member 42. Accordingly, even when the elastic layer of the pressing roller 15 has a small thickness, it is possible to secure a sufficient nip width, thereby obtaining good fixing performance under a relatively low temperature and a relatively low pressure. It is arranged that the fixing roller 14 has a heat capacity larger than that of the pressing roller 15.

In the embodiment, the heater 16*a* is connected to the power source 51 as a first voltage applying device. Further, the heater 17 and the heater 18 are connected to a power source 55 as a second voltage applying device. The power sources 51 and 55 apply voltages to the heater 16*a*, the heater 17, and the heater 18 for heating. When the fixing device 10 has a rated voltage of 100 V, it is configured such that the heater 16 has the rated output $P_1$ of 600 W; the heater 17 has the rated output $P_2$ of 350 W; and the heater 18 has the rated output $P_3$ of 50 W. Accordingly, the rated outputs $P_1$ to $P_3$ have the following relationship.

$$P_1 > P_2 \geqq P_3$$

In the embodiment, the heater 16 functions as a main heater, and the heater 17 and the heater 18 connected to the power source 55 in series function as sub-heaters having the rated outputs of 400 W (350+50). A total of the rated outputs $P_1$ to $P_3$ is adapted to be 1000 W considering a startup time and allowable power of the fixing device 10.

The thermistor 19 as the first temperature detection unit is disposed adjacent to or contacts with the fixing roller 14; and the thermistor 20 as the second temperature detection unit is disposed adjacent to or contacts with the pressing roller 15. The first temperature representing the temperature of the fixing roller 14 detected with the thermistor 19 is sent to the control unit 53. The second temperature representing the temperature of the pressing roller 15 detected with the thermistor 20 is sent to a control unit 56.

The power control process unit of the control unit 53 compares the first temperature with a set temperature of 175° C. When the first temperature exceeds 175° C., the power control process unit turns off a signal to the triac 52 (FIG. 3), thereby terminating the voltage supplied to the heater 16*a*. Further, a power control process unit (not shown) of the control unit 56 compares the second temperature with a set temperature of 150° C. When the second temperature exceeds 150° C., the power control process unit turns off a signal to the triac 54 as the second application control unit, thereby terminating the voltages supplied from the power source 55 to the heater 17, and the heater 18.

In the embodiment, the thermistor 20 is provided in the pressing roller 15, and the power of the power source 55 supplied to the heater 17 and the heater 18 is controlled simultaneously according to the second temperature detected with the thermistor 20, thereby increasing the thermal response in the temperature control.

In the embodiment, a voltage of the power source 51 is applied to the heater 16*a*. Separately, a voltage of the power source 55 is applied to the heaters 17 and 18. Accordingly, it is possible to provide the heater 16*a* with a heat distribution corresponding to a sheet P with a narrow width, and to provide the heater 17 with a heat distribution corresponding to a sheet P with a wide width. Further, when the sheet P with a narrow width is fixed, the power to the heater 17 is controlled. Accordingly, it is possible to prevent a portion where the sheet does not pass from heating up too high.

In the embodiment, a voltage of the power source 51 is applied to the heater 16*a*. Separately, a voltage of the power source 55 is applied to the heaters 17 and 18. Alternatively, a single power source may apply a voltage to the heaters 16*a*, 17, and 18. In the embodiment, the control units 53 and 56 are provided, and a single control unit may be provided.

An operation of the fixing device 10 will be explained next. After the printer 60 (FIG. 2) is turned on, and the heaters 16*a*, 17, and 18 are powered on, when the first temperature reaches 175° C., the startup of the fixing roller 14 is completed. Further, when the second temperature reaches 150° C., the startup of the pressing roller 15 is completed. When the printing operation starts, the pressing belt 41 starts to move. At this time, since the heater 18 is disposed in the pressing roller 15, the temperature of the fixing roller 14 does not decrease rapidly due to heat transferring from the fixing roller 14 to the pressing roller 15 and the pressing belt 41.

As described above, in the embodiment, without providing a complex structure for controlling the temperatures, it is possible to prevent the temperature of the fixing roller 14 from decreasing due to the pressing roller 15 disposed in the pressing belt 41, thereby preventing a fixing problem.

Sixth Embodiment

A sixth embodiment of the present invention will be explained next. Components same as those in the first and fifth embodiments are designated with the same numeral references, and explanations thereof are omitted. The components same as those in the first and fifth embodiments provide the same effects.

Figure 10:
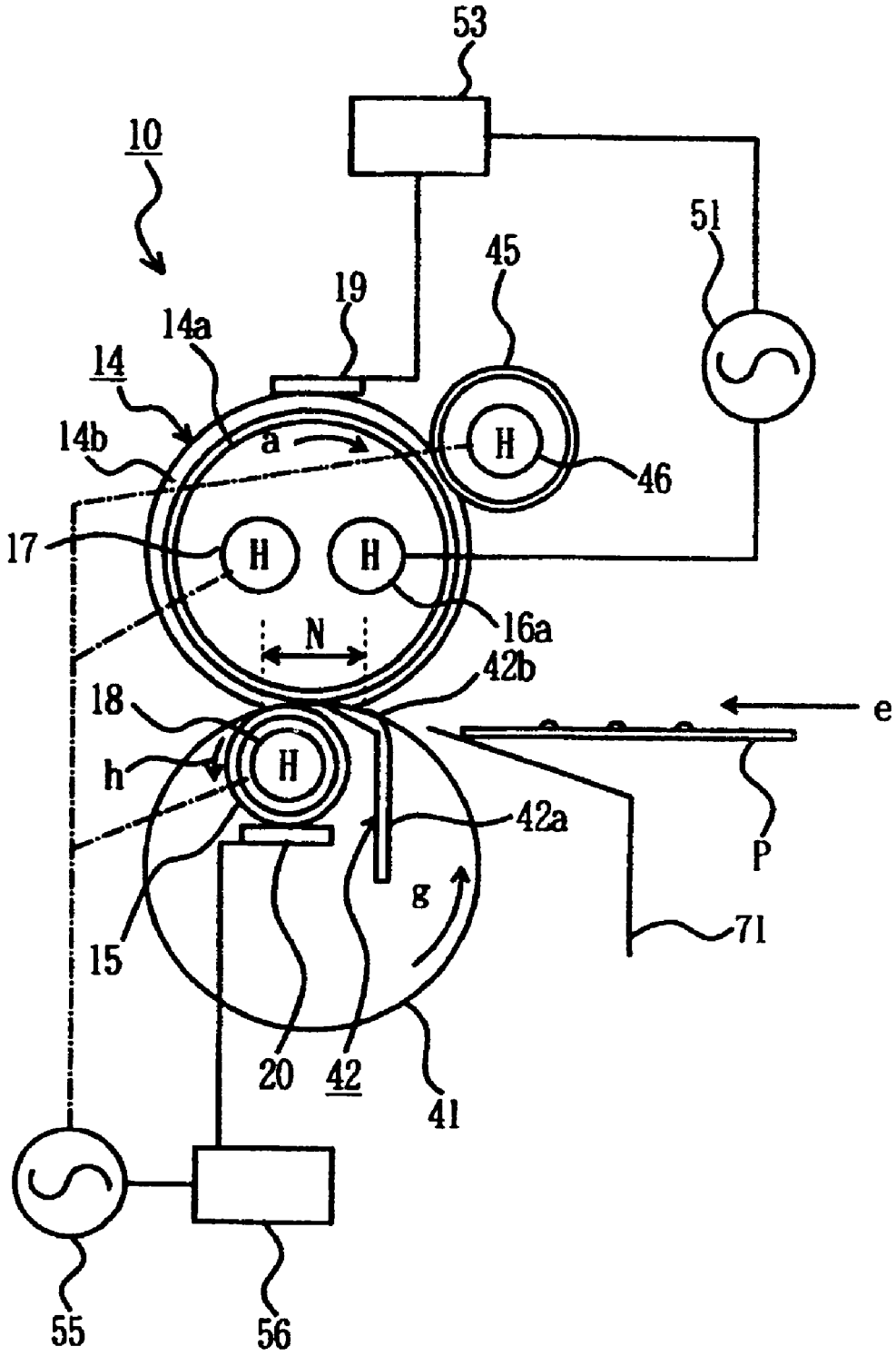
FIG. 10 is a schematic side view showing a fixing device according to a sixth embodiment of the present invention.

FIG. 10 is a schematic side view showing a fixing device 10 according to the fifth embodiment of the present invention. As shown in FIG. 10, the fixing device 10 is provided with an external heating roller 45 contacting with the fixing roller 14 as the fixing member or the second rotational member, so that the fixing can be performed at a high speed.

The external heating roller 45 is formed of a core metal having a cylindrical shape with a thin wall thickness. The core metal has an outer diameter between 15 mm and 30 mm and a thickness between 0.3 mm and 1.5 mm. In the embodiment, the external heating roller 45 is formed of aluminum, and has an outer diameter of 20.0 mm and a thickness of 0.5 mm. A heater 46 is disposed as a seventh heating member on a center axis of the core metal. The external heating roller 45 constitutes a temperature compensation member for compensating the temperature of the fixing roller 14, and the heater 46 constitutes a temperature compensation member heating member.

In the embodiment, the heater 16*a* as the first heating member or the main heating member is connected to the power source 51 as the first voltage applying device. Further, the heater 17 as the second heating member or the fixing member heating member, the heater 18 as the third heating member or the pressing member heating member, and the heater 46 are connected to the power source 55 as the second voltage applying device. The power sources 51 and 55 apply voltages to the heater 16*a*, the heater 17, the heater 18 and the heater 46 for heating. When the fixing device 10 has a rated voltage of 100 V, it is configured such that the heater 16 has the rated output $P_1$ of 600 W; the heater 17 has the rated output $P_2$ of 180 W; the heater 18 has the rated output $P_3$ of 120 W; and the heater 46 has a rated output $P_4$ of 100 W. Accordingly, the rated outputs $P_1$ to $P_4$ have the following relationship.

$$P_1 > P_2 \geqq P_3 > P_4$$

In the embodiment, the heater 16 functions as the main heater, and the heater 17, the heater 18, and the heater 46 connected to the power source 55 in series function as sub-heaters (in FIG. 10, the connection indicated by a projected line is parallel for convenience). The sub-heaters have the rated outputs of 400 W (180+120+100). A total of the rated outputs $P_1$ to $P_4$ is adapted to be 1000 W considering a startup time and allowable power of the fixing device 10.

The thermistor 19 as the first temperature detection unit is disposed adjacent to or contacts with the fixing roller 14; and the thermistor 20 as the second temperature detection unit is disposed adjacent to or contacts with the pressing roller 15 as the pressing member or the third rotational member. The first temperature representing the temperature of the fixing roller 14 detected with the thermistor 19 is sent to the control unit 53. The second temperature representing the temperature of the pressing roller 15 detected with the thermistor 20 is sent to the control unit 56.

The power control process unit of the control unit 53 compares the first temperature with a set temperature of 175° C. When the first temperature exceeds 175° C., the power control process unit turns off a signal to the triac 52 (FIG. 3), thereby terminating the voltage supplied to the heater 16*a*. Further, the power control process unit of the control unit 56 compares the second temperature with a set temperature of 150° C. When the second temperature exceeds 150° C., the power control process unit turns off a signal to the triac 54 as the second application control unit, thereby terminating the voltages supplied from the power source 55 to the heater 17, the heater 18, and the heater 46.

In the embodiment, the thermistor 20 is provided in the pressing roller 15, and the power of the power source 55 supplied to the heater 17, the heater 18, and the heater 46 is controlled simultaneously according to the second temperature detected with the thermistor 20, thereby increasing the response in the temperature control.

In the embodiment, a voltage of the power source 51 is applied to the heater 16*a*. Separately, a voltage of the power source 55 is applied to the heaters 17, 18, and 46. Accordingly, it is possible to provide the heater 16*a* with a heat distribution corresponding to a sheet P with a narrow width, and to provide the heater 17 with a heat distribution corresponding to a sheet P with a wide width. Further, when the sheet P with a narrow width is fixed, the power to the heater 17 is controlled. Accordingly, it is possible to prevent a portion where the sheet does not pass from heating up too high.

An operation of the fixing device 10 will be explained next. After the printer 60 (FIG. 2) is turned on, and the heaters 16*a*, 17, 18, and 46 are powered on, when the first temperature reaches 175° C., the startup of the fixing roller 14 is completed. Further, when the second temperature reaches 150° C., the startup of the pressing roller 15 is completed. When the printing operation starts, the pressing belt 41 starts to move. At this time, since the heater 18 is disposed in the pressing roller 15, the temperature of the fixing roller 14 does not decrease rapidly due to heat transferring from the fixing roller 14 to the pressing roller 15 and the pressing belt 41.

Further, the rate output $P_4$ is smaller than the rated output $P_1$ and the rated output $P_1$ according to the heat capacities of the fixing roller 14 and the pressing roller 15. Accordingly, when sheets are continuously fixed, it is possible to prevent the temperature of the fixing roller 14 from increasing too much.

As described above, in the embodiment, the external heating roller 45 heats the surface of the fixing roller 14 before the fixing roller 14 is heated from inside. Accordingly, when the fixing operation is performed at a high speed, it is possible to prevent the temperature of the fixing roller 14 from decreasing. Further, without providing a complex structure for controlling the temperatures, it is possible to prevent the temperature of the fixing roller 14 from decreasing due to the pressing roller 15 disposed in the pressing belt 41, thereby preventing a fixing problem. The power sources 51 and 55 are connected to the heaters 16, 16*a*, 17, 18, 23, 31, and 36. Alternatively, a single power source is separately connected to each of the heaters 16, 16*a*, 17, 18, 23, 31, and 36.

The disclosure of Japanese Patent Application No. 2005-190855, filed on Jun. 30, 2005, is incorporated in the application.

While the invention has been explained with reference to the specific embodiments of the invention, the explanation is illustrative and the invention is limited only by the appended claims.

What is claimed is:

1. A fixing device comprising:

a fixing member;

a pressing member to be pressed against the fixing member;

a first heating member for heating the fixing member, said first heating member having a first rated output;

a second heating member for heating the fixing member, said second heating member having a second rated output smaller than the first rated output; and a third heating member for heating the pressing member, said third heating member having a third rated output equal to or smaller than the second rated output, said third heating member being connected to the second heating member in series relative to a voltage applying device.

2. The fixing device according to claim 1, wherein said fixing member includes a first roller to be heated by the first heating member; a second roller to be heated by the second heating member; and a belt member placed between the first roller and the second roller.

3. The fixing device according to claim 1, further comprising a first temperature detection unit for detecting a first temperature of the fixing member; and a second temperature detection unit for detecting a second temperature of the pressing member so that power to the first heating member is controlled according to the first temperature and power to the second heating member and the third heating member is controlled according to the second temperature.

4. The fixing device according to claim 1, further comprising a release agent coating member for applying a release agent to the fixing member; and a fourth heating member for heating the fixing member through the release agent coating member, said fourth heating member having a fourth rated output smaller than the third rated output, said fourth heating member being connected to the second heating member and the third heating member in series relative to the voltage applying device.

5. The fixing device according to claim 2, further comprising a pushing member disposed in the belt member for pushing the belt member against the pressing member; and a fourth heating member for heating the belt member through the pushing member, said fourth heating member having a fourth rated output smaller than the third rated output, said fourth heating member being connected to the second heating member and the third heating member in series relative to the voltage applying device.

6. The fixing device according to claim 2, further comprising a release agent coating member for applying a release agent to the belt member; a third roller for applying tension to the belt member from an outer circumference thereof; a fourth heating member for heating the belt member through the release agent coating member, said fourth heating member having a fourth rated output smaller than the third rated output; and a fifth heating member for heating the belt member through the third roller, said fifth heating member having a fifth rated output smaller than the fourth rated output, said fifth heating member being connected to the second heating member, the third heating member, and the fourth heating member in series relative to the voltage applying device.

7. The fixing device according to claim 1, wherein said fixing member includes a rotational body, said first heating member and said second heating member being disposed in the rotational body and extending along a width of the rotational body so that the first heating member provides a heat distribution smaller than that of the second heating member.

8. The fixing device according to claim 1, wherein said fixing member includes a roller, and said pressing member includes a belt, said third heating member disposed in the belt.

9. The fixing device according to claim 1, further comprising a first pushing member for pushing the fixing member through the pressing member; and a second pushing member for pushing the fixing member through the pressing member, said third heating member being disposed in the first pushing member.

10. The fixing device according to claim 1, further comprising a fourth heating member for heating an outer circumference of the fixing member, said fourth heating member having a fourth rated output smaller than the third rated output, said fourth heating member being connected to the second heating member and the third heating member in series relative to the voltage applying device, said fixing member including a roller retaining the first heating member and the second heating member.

11. An image forming apparatus comprising the fixing member according to claim 1.

* * * * *